US008950163B2

(12) United States Patent
Fischer et al.

(10) Patent No.: US 8,950,163 B2
(45) Date of Patent: Feb. 10, 2015

(54) PACKAGING MACHINE FOR GOODS IN BLISTER SHELL MOLDINGS TO BE SEALED WITH A BLISTER FILM

(75) Inventors: Jörg-Achim Fischer, Laboe (DE); Timo Ihfe, Todenbüttel (DE); Christian Matthiesen, Kiel (DE); Wilhelm Paulsen, Kiel (DE); Burghart Schnabel, Kiel (DE); Holger Suhr, Kiel (DE); Jörg Suhr, Rickert (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1093 days.

(21) Appl. No.: 12/425,508

(22) Filed: Apr. 17, 2009

(65) Prior Publication Data

US 2009/0260322 A1 Oct. 22, 2009

(30) Foreign Application Priority Data

Apr. 17, 2008 (DE) ..... 10 2008 019 482

(51) Int. Cl.

*B65B 61/26* (2006.01)
*B41J 3/407* (2006.01)
*B41J 2/165* (2006.01)
(Continued)

(52) U.S. Cl.

CPC ..... *B41J 3/407* (2013.01); *B41J 2/16585* (2013.01); *B41J 11/002* (2013.01); *B41J 15/046* (2013.01); *B41J 15/165* (2013.01); *B65B 9/04* (2013.01); *B65B 41/16* (2013.01); *B65B 55/24* (2013.01); *B65B 61/025* (2013.01); *B65H 23/16* (2013.01);
(Continued)

(58) Field of Classification Search

USPC ..... 53/131.2, 558, 559, 561, 534, 131.5, 53/452, 431, 432, 471, 485, 488, 489, 510, 53/511, 545, 562, 281

See application file for complete search history.

(56) References Cited

U.S. PATENT DOCUMENTS 3,070,045 A * 12/1962 Bowe ..... 425/9
3,330,515 A * 7/1967 Janssen et al. ..... 248/606
(Continued)

FOREIGN PATENT DOCUMENTS

EP 0088630 A2 9/1983
GB 2247874 A 3/1992

OTHER PUBLICATIONS

German Search Report dated Feb. 16, 2009.

*Primary Examiner* — Robert Long
(74) *Attorney, Agent, or Firm* — Laurence A. Greenberg; Werner H. Stemer; Ralph E. Locher

(57) ABSTRACT

A packaging machine seals goods in blister shell moldings with a blister film. The packaging machine contains a first transport system for a blister film web, a second transport system for blister shell moldings, and a sealing apparatus, the effect of which is to connect a blister shell molding to a portion of the blister film web. A printing apparatus is provided for applying optical information to the blister film web. A dancing roller system is provided for motional decoupling and disposed between a position at which the printing apparatus prints on the blister film web and the sealing apparatus along the blister film. The printing apparatus and/or the first transport system for the blister film web contains an apparatus for insulating against occurring vibrations of the rest of the packaging machine at the position at which the printing apparatus prints on the blister film web.

11 Claims, 8 Drawing Sheets

(51) Int. Cl.

| | |
|---|---|
| ***B41J 11/00*** | (2006.01) |
| ***B41J 15/04*** | (2006.01) |
| ***B41J 15/16*** | (2006.01) |
| ***B65B 9/04*** | (2006.01) |
| ***B65B 41/16*** | (2006.01) |
| ***B65B 55/24*** | (2006.01) |
| ***B65B 61/02*** | (2006.01) |
| ***B65H 23/16*** | (2006.01) |

(52) U.S. Cl.

CPC ..... *B65H 2601/524* (2013.01); *B65H 2801/81* (2013.01)

USPC ..... 53/131.2

(56) References Cited

U.S. PATENT DOCUMENTS

| | | | | | |
|---|---|---|---|---|---|
| 3,546,503 | A | * | 12/1970 | Richardson | 310/51 |
| 3,814,357 | A | * | 6/1974 | Rontgen | 248/573 |
| 4,072,552 | A | * | 2/1978 | Ewing | 156/379.8 |
| 4,262,474 | A | * | 4/1981 | Reuter et al. | 53/551 |
| 4,559,755 | A | * | 12/1985 | Romagnoli | 53/64 |
| 4,587,995 | A | * | 5/1986 | Bolleter et al. | 139/1 R |
| 4,753,059 | A | * | 6/1988 | Natterer | 53/131.5 |
| 5,187,921 | A | * | 2/1993 | Wilson et al. | 53/453 |
| 5,511,961 | A | * | 4/1996 | Sullivan | 425/9 |
| 5,659,229 | A | * | 8/1997 | Rajala | 318/6 |
| 5,666,785 | A | | 9/1997 | Jouffreau et al. | |
| 6,079,188 | A | * | 6/2000 | Katayama et al. | 53/451 |
| 6,164,200 | A | | 12/2000 | Mathea | |
| 6,329,047 | B1 | * | 12/2001 | Beer et al. | 428/215 |
| 6,550,905 | B1 | * | 4/2003 | Deckers | 347/100 |
| 6,564,710 | B1 | * | 5/2003 | Mathea | 101/227 |
| 6,851,874 | B2 | * | 2/2005 | Gonzalez et al. | 400/61 |
| RE39,242 | E | * | 8/2006 | Johnson et al. | 347/28 |
| 7,757,464 | B2 | * | 7/2010 | Hirata et al. | 53/452 |
| 2002/0012108 | A1 | * | 1/2002 | Hara | 355/53 |
| 2005/0155713 | A1 | * | 7/2005 | Mathea | 156/361 |
| 2006/0000540 | A1 | | 1/2006 | Mathea | |
| 2006/0032353 | A1 | * | 2/2006 | Dahlberg | 83/82 |
| 2007/0220827 | A1 | * | 9/2007 | Conti | 53/111 R |

* cited by examiner

PACKAGING MACHINE FOR GOODS IN BLISTER SHELL MOLDINGS TO BE SEALED WITH A BLISTER FILM

CROSS-REFERENCE TO RELATED APPLICATION

This application claims the priority, under 35 U.S.C. §119, of German application DE 10 2008 019 482.4, filed Apr. 17, 2008; the prior application is herewith incorporated by reference in its entirety.

BACKGROUND OF THE INVENTION

Field of the Invention

The invention relates to a packaging machine for goods in blister shell moldings to be sealed with a blister film. The packaging machine has a first transport system for a blister film web, a second transport system for blister shell moldings, a sealing apparatus for connecting a blister shell molding to a portion of the blister film web to seal the blister shell molding, a printing apparatus for applying optical information to the blister film web, and a dancing roller system for motional decoupling being arranged between the position at which the printing apparatus prints on the blister film web and the position of the sealing apparatus along the blister film.

A large number of different goods or products are bound, and/or presented to a potential customer or user, in blister packs. For this purpose, a blister pack contains a blister shell molding, which has at least one shell-shaped, concave, dimensionally stable shaping, in which one or more goods items can be accommodated. Familiar blister shell moldings typically consist of transparent or opaque plastic. The blister shell moldings provided with the goods are sealed with a blister film. Familiar blister films typically have one or more layers, with polymers, papers, boards or metals, such as, in particular, aluminum, being used as the materials. The packaging of pharmaceuticals, for example tablets, pills or capsules, in blister packs is particularly widespread. The blister film of these pharmaceutical packs is here frequently provided with an imprint.

The majority of such printed blister films, particularly in the form of webs, are today provided with an imprint outside of the actual packaging plants or packaging machines, in particular are produced in flexographic printing presses. Where the blister shell moldings are sealed within a packaging machine, the problem then arises that the length of the premade imprint on the blister film web does not always exactly conform to the length of the blister shell moldings, so that a stretching apparatus becomes necessary to draw the blister film to the necessary length before this is connected to the blister shell moldings.

Alternatively, it is also known to integrate a printing apparatus in a packaging machine in order to provide an initially unprinted blister film web with an imprint before it is fed to blister shell moldings to be sealed. Such an arrangement is disclosed, for example, in U.S. Pat. No. 6,164,200. In order to achieve a correlation of the printing onto the blister film web with the supply of blister shell moldings to a sealing apparatus in the form of a sealing roller, the printing apparatus is driven such that it is triggered in dependence on the sensor-detected location of the supplied blister shell moldings. In order to decouple the movement of the blister film web during the sealing operation from that during printing, a web accumulator for the blister film web is additionally provided between the position of the printing apparatus and the position of the sealing roller.

It has been shown in practice, however, that the print is exposed within a packaging machine to various influences which have a disturbing, in particular degrading effect upon the precision of the location of the print. For example, speed changes or speed variations arise in the supply of the blister film or blister shell moldings to the sealing apparatus, so that the time of generation of the triggering signal is defective. A web accumulator also gives rise to an additional inaccuracy. On top of this, the actual length of a blister shell molding, by dint of its production, can fluctuate about an ideal, theoretical length. In practice, it is therefore necessary to adopt further measures to increase the precision of the location of the print on the blister film.

SUMMARY OF THE INVENTION

It is accordingly an object of the invention to provide a packaging machine for goods in blister shell moldings to be sealed with a blister film that overcomes the above-mentioned disadvantages of the prior art devices of this general type, which alleviates disturbing, in particularly mechanically conditioned influences upon the precision of the location of the blister film relative to the blister shell molding.

An inventive packaging machine for goods in blister shell moldings to be sealed with a blister film contains a first transport system for a blister film web, a second transport system for blister shell moldings, a sealing apparatus, the effect of which is to connect a blister shell molding to a portion of the blister film web in order to seal the blister shell molding, a printing apparatus for applying optical information to the blister film web, and a dancing roller system for motional decoupling being disposed between the position at which the printing apparatus prints on the blister film web and the position of the sealing apparatus along the blister film. According to the invention, the printing apparatus and/or the first transport system for the blister film web has/have an apparatus for insulating against occurring vibrations of the rest of the packaging machine at the position at which the printing apparatus prints on the blister film web.

Disturbing vibrations or movements of the packaging machine, particularly uneven movements or accelerations induced by the sealing apparatus, are advantageously prevented, according to the invention, from having a degrading influence upon the print. The printing apparatus, and/or that portion of the blister film web which is assigned to the printing apparatus for printing, is/are decoupled from undesirable movements of other parts of the packaging machine. In this way, in advantageous consequence, a precise target print onto the blister film can be achieved with the printing apparatus in the packaging machine. In other words, the quality of the imprint onto the blister film web fed to the printing apparatus, in particular of a multitude of different substrate types, can be enhanced. The influence of mechanical disturbances in the feed system is minimized. No dedicated (costly) drive mechanism for the printing system, the portion of blister film web under the printing apparatus, is necessary.

The packaging machine according to the invention can be, in particular, a pharmaceuticals packaging machine, for example, for tablets, pills or capsules. The packaging machine can also be referred to as a blistering machine. The print can be realized on one side or both sides of the blister film web. A one-sided printing on the subsequent outer side of the blister film of the blister pack is common. The sealing apparatus can operate in a timed or cyclical manner. The sealing of the blister shell moldings can be realized, in particular, by heat fusion or gluing. The printing apparatus can preferably be disposed along the blister film web before the sealing apparatus. The printing apparatus can be a digital printing apparatus, so that the imprint can be realized variably, in particular variably both in terms of its content and in terms of its size or shape. In other words, the length and/or position of an imprint produced with a digital printing apparatus is/are freely controllable. The printing apparatus can print on the blister film web, in particular also without contact. Directly before the printing apparatus, a displacement transducer can be provided. In particular, a blister shell molding, which is transported with the second transport device to the sealing apparatus, can be detected before the sealing apparatus. The sensor can be a reflex light barrier. The generation of the triggering signal can be realized, in particular, using a threshold value process. The blister shell moldings can be fed with the second transport device to the sealing apparatus linked or joined together in the form of a web. Alternatively, in one group of embodiments, the sealing apparatus can also be fed single blister shell moldings. For the purpose of sealing a blister shell molding with a piece of blister film, a portion can be cut off from the blister film web before the sealing apparatus. Alternatively, the end of the blister film web can first be connected in the sealing apparatus to the end of the web of linked blister shell moldings, and sealed blister shell moldings are then cut off from the web. The blister film web can consist, in particular, of a material mentioned in the introduction, for example an aluminum layer. The optical information can, in particular, be visible or visual.

Particularly preferably, in the process according to the invention, the printing apparatus is an inkjet printing system. In particular, the inkjet printing system can have one or more modules of drop-on-demand inkjet printing apparatuses. In other words, the use of an inkjet printing system is preferred. The inkjet printing apparatuses can have a plurality of discharge nozzles, which can be arranged, in particular, in lines. The inkjet printing system can preferably have a resolution greater than 600 dpi (dots per inch), in particular, for example, 720 dpi. The inkjet printing system can be constructed in page width for the entire width of the blister film web due to be printed on.

In one group of embodiments of the packaging machine according to the invention, the dancing roller system has a deflection roll, displaceable counter to the force of a restoring element, for damping longitudinal running vibrations of the blister film web. In other words, an apparatus for insulating against occurring vibrations of the rest of the packaging machine is integrated in the dancing roller system.

In a series of packaging machines, the transport system contains an unreeling device or an unwinding apparatus for the blister film web. The blister film web can here initially be unprinted, or printed only with static or general information.

In one refinement of the packaging machine according to the invention of the aforesaid series, along the blister film web, a further dancing roller system for motional decoupling is disposed between the position of the unreeling device and the position at which the printing apparatus prints on the blister film web.

In addition or alternatively to the described features, the packaging machine can have a number of mechanical vibration pickups (vibration dampers), by which vibrations acting on the printing apparatus are damped. In particular, the number of mechanical vibration pickups can be rubber-metal buffers or steel-wire-damped springs.

The packaging machine according to the invention can have a single motor drive for moving the blister film web along the printing apparatus.

In one refinement of the packaging machine, ink which can be dried with ultraviolet radiation is used, and the ink imprinted on a portion of the blister film web with the inkjet printing system is dried before the portion reaches the sealing apparatus. In particular, the packaging machine can for this purpose have a UV drying apparatus, which is disposed downstream of the printing apparatus along the path of the blister film web through the packaging machine, in particular is disposed upstream of the sealing roller. This prevents the print image from being destroyed on the printed side when the blister film web is deflected via rolls.

At least one deflection roll for the blister film web in the packaging machine according to the invention can be of crowned construction.

In addition or alternatively to the described features, in one refinement of the packaging machine a control unit can be provided, with which a guide mechanism for stabilizing the movement of the blister film web in the direction transversely to the feed can be driven.

In advantageous and preferred embodiments, the inkjet printing system contains a number of printing modules disposed in a carrier plate and a drain pan or purge pan with a cleaning apparatus accommodated on one side of the purge pan. The number of printing modules are movable in the vertical direction and are advanceable to the blister film web. The purge pan with the cleaning apparatus is movable in the horizontal direction from a parking position into a cleaning position below the printing modules, and back. In particular, the cleaning apparatus can contain a contactless vacuum extraction for ink from the printing modules.

For a person of ordinary skill in the art addressed by this representation, it will be immediately and abundantly clear that the cited features are herewith disclosed individually, and in feature groupings combined therefrom, and can be provided in processes according to the invention. In particular, from the order in which individual features are represented, it cannot be inferred that the first-named features must necessarily also be present in a specific combination of features.

Other features which are considered as characteristic for the invention are set forth in the appended claims.

Although the invention is illustrated and described herein as embodied in a packaging machine for goods in blister shell moldings to be sealed with a blister film, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
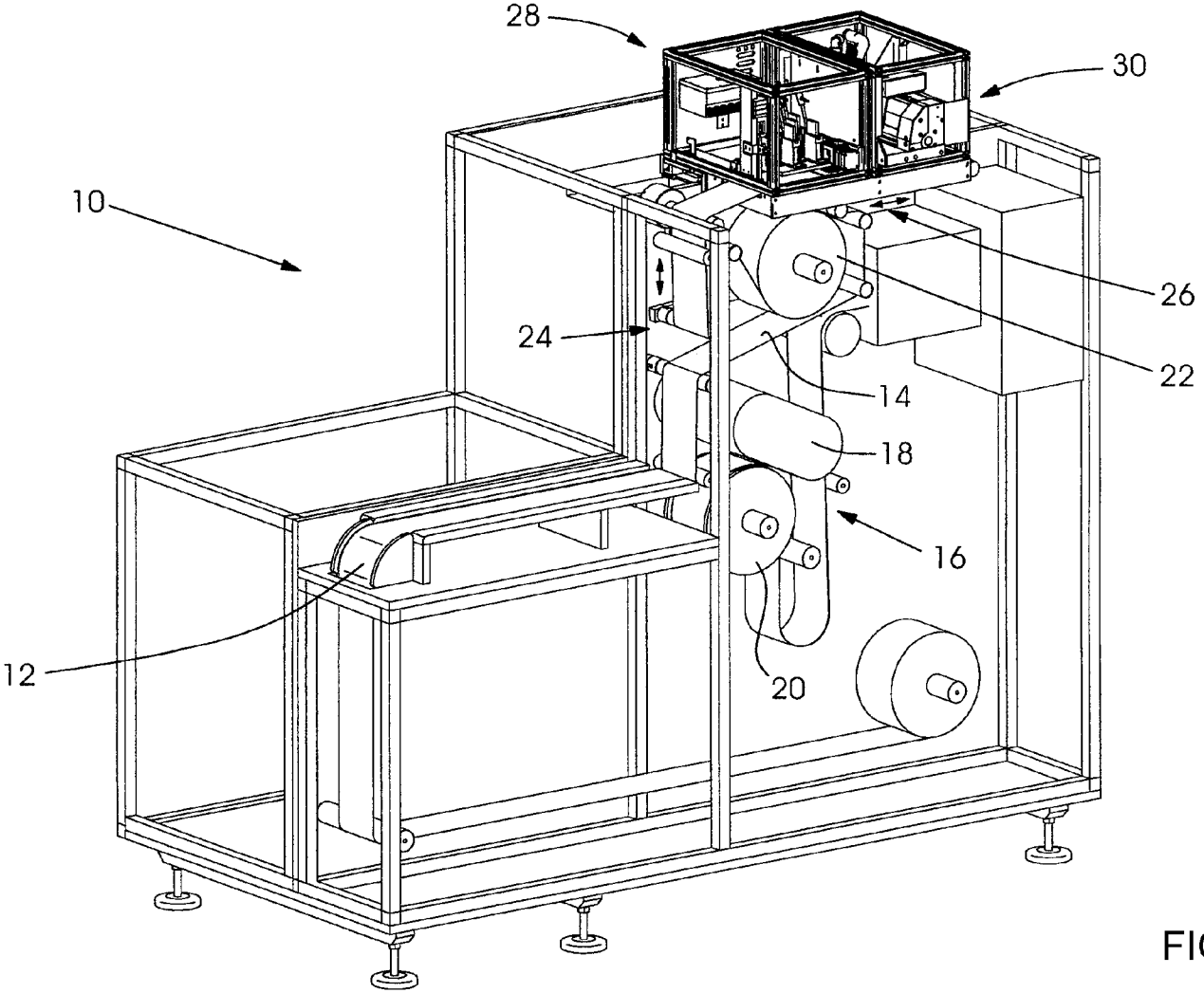
FIG. 1 is a diagrammatic, perspective view of an embodiment of a packaging machine according to the invention.

Referring now to the figures of the drawing in detail and first, particularly, to FIG. 1 thereof, there is shown a view of one embodiment of a packaging machine 10 according to the invention. Strip-shaped blister film 14 is fed by a first transport system, and blister shell moldings 12, still connected in a strip shape, are fed by a second transport system to a sealing apparatus 16. The sealing apparatus 16 contains a sealing roller 18 and a counterpressure roller 20, by which, in interaction, the blister shell moldings 12 seal with the blister film 14. In the packaging machine 10, the transport of the blister film web 14 both to the sealing apparatus 16 and beneath the printing apparatus 28 is effected by a drive mechanism. Prior to being worked, the strip-shaped blister film 14 is wound on a roll. Starting from the unreeling device 22, the blister film web 14 first passes a second dancing roller system 24, in which a lower web guide roller is pivotable. The blister film web 14 then runs beneath a printing apparatus 28, in this embodiment a monochromatic inkjet printing system for the application of UV-hardenable ink, and a directly following UV drying device 30. The portion or area of the blister film web 14 beneath the printing apparatus 28 is separated in terms of its movement, by a first dancing roller system 26, from the portion fed to the sealing apparatus 16. With the first dancing roller system 26 according to the invention, the printing apparatus 28, or that portion of the blister film web 14 which is to be printed on by the printing apparatus 28, is decoupled from the uneven movements induced by the sealing roller 18.

Figure 2:
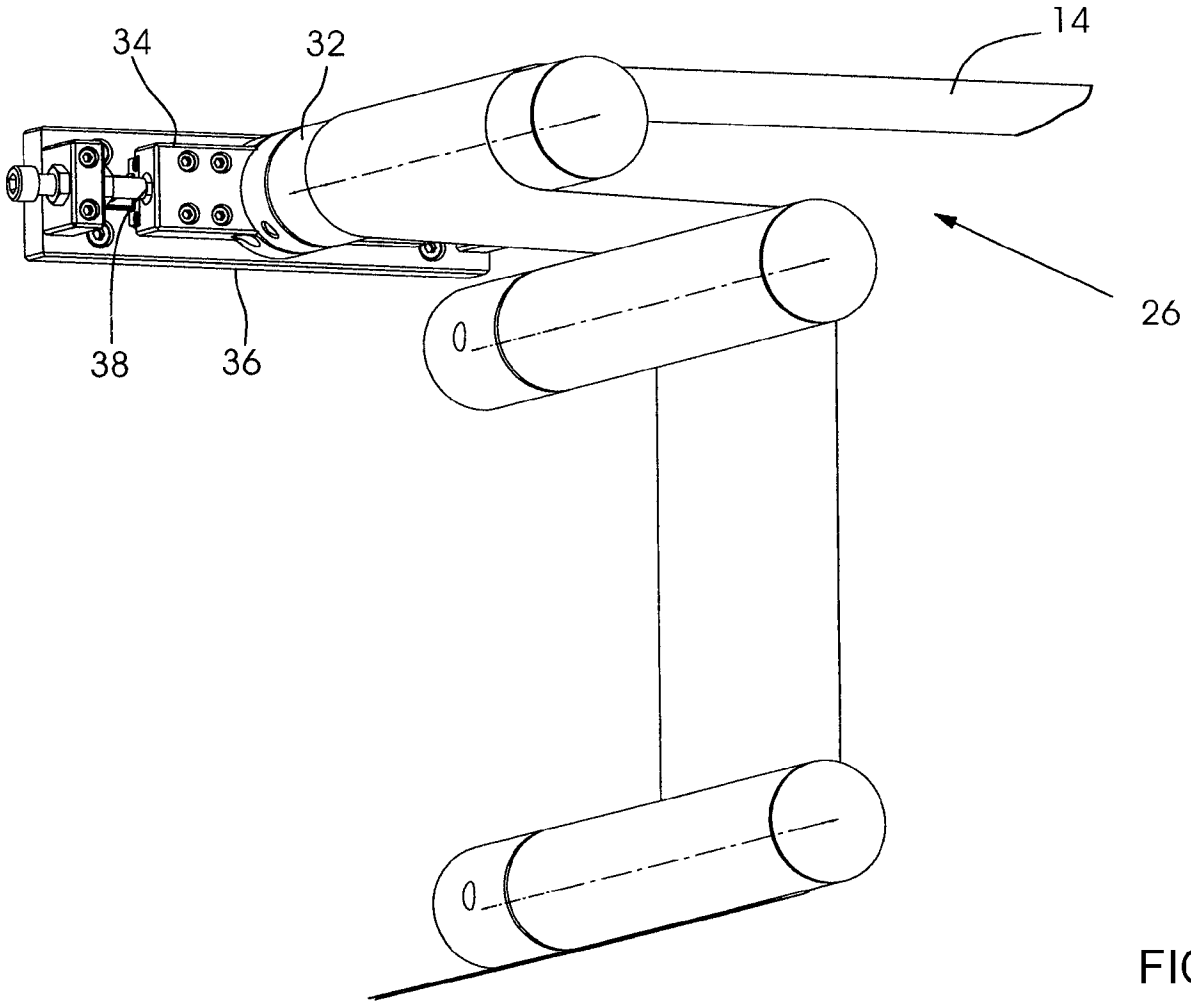
FIG. 2 is a diagrammatic, perspective view of a first dancing roller system shown in FIG. 1.

FIG. 2 is a schematic view of the first dancing roller system 26, a detail of FIG. 1, with which, according to the invention, longitudinal web-running vibrations are intended to be absorbed or damped in the longitudinal direction. By the sealing roller 18, strong positive and negative accelerations are transmitted to the blister film web 14. The blister film web 14 can temporarily even run backward. Though the printing can be timed by an encoder, this, or the drive system of the printing modules of the printing apparatus 28, is incapable of tracking the high-frequency disturbances. The first dancing roller system 26 contains a dancing roller 32 as a deflection roller on a slide 34 mounted on a slide rail. The dancing roller 32 can be moved in a substantially horizontal direction linearly along a base 36. In this embodiment, high-frequency movements of the slide 34 are damped according to the invention by a tension spring 38, as the apparatus for insulating against occurring vibrations.

Figure 3:
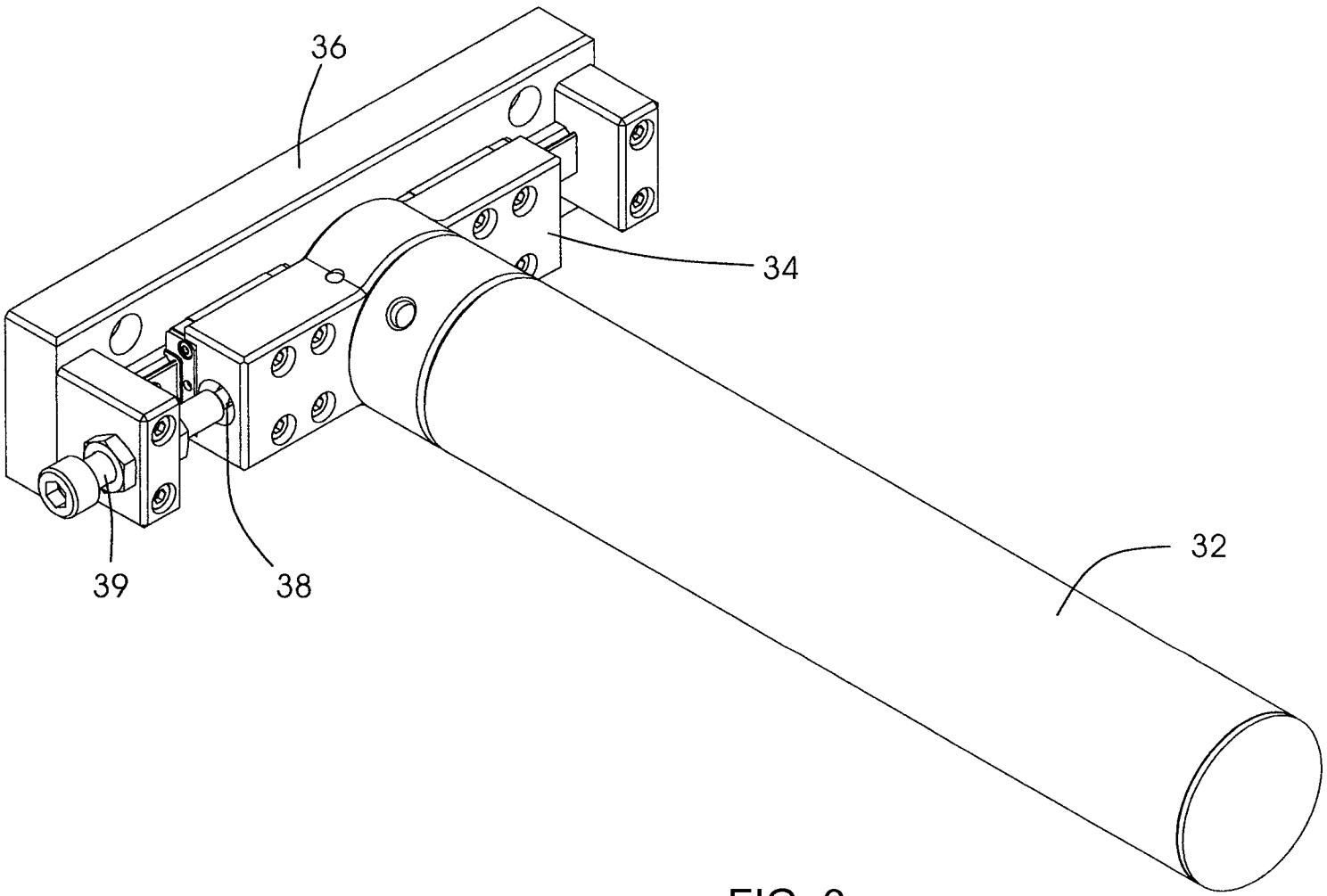
FIG. 3 is a diagrammatic, perspective view of a dancing roll, together with the mechanics of the first dancing roller system shown in FIG. 2.

FIG. 3 shows a representation of the dancing roll 32, together with the mechanics of the first dancing roller system 26 of FIG. 2. The dancing roll 32 is accommodated on a slide 34, which is linearly movable against the base 36. The tension spring 38 is integrated in the slide 34, and the force action is adjustable by an adjusting screw 39. The configuration of the dancer, modeled as a spring-mass system, is calculated from the occurring frequencies and distances such that, in the region of the printing apparatus, a smooth and even running of the blister film web is produced, since the vibrations from the web running are reduced or eliminated. By virtue of a very light construction, correspondingly high frequencies are able to be absorbed.

Figure 4:
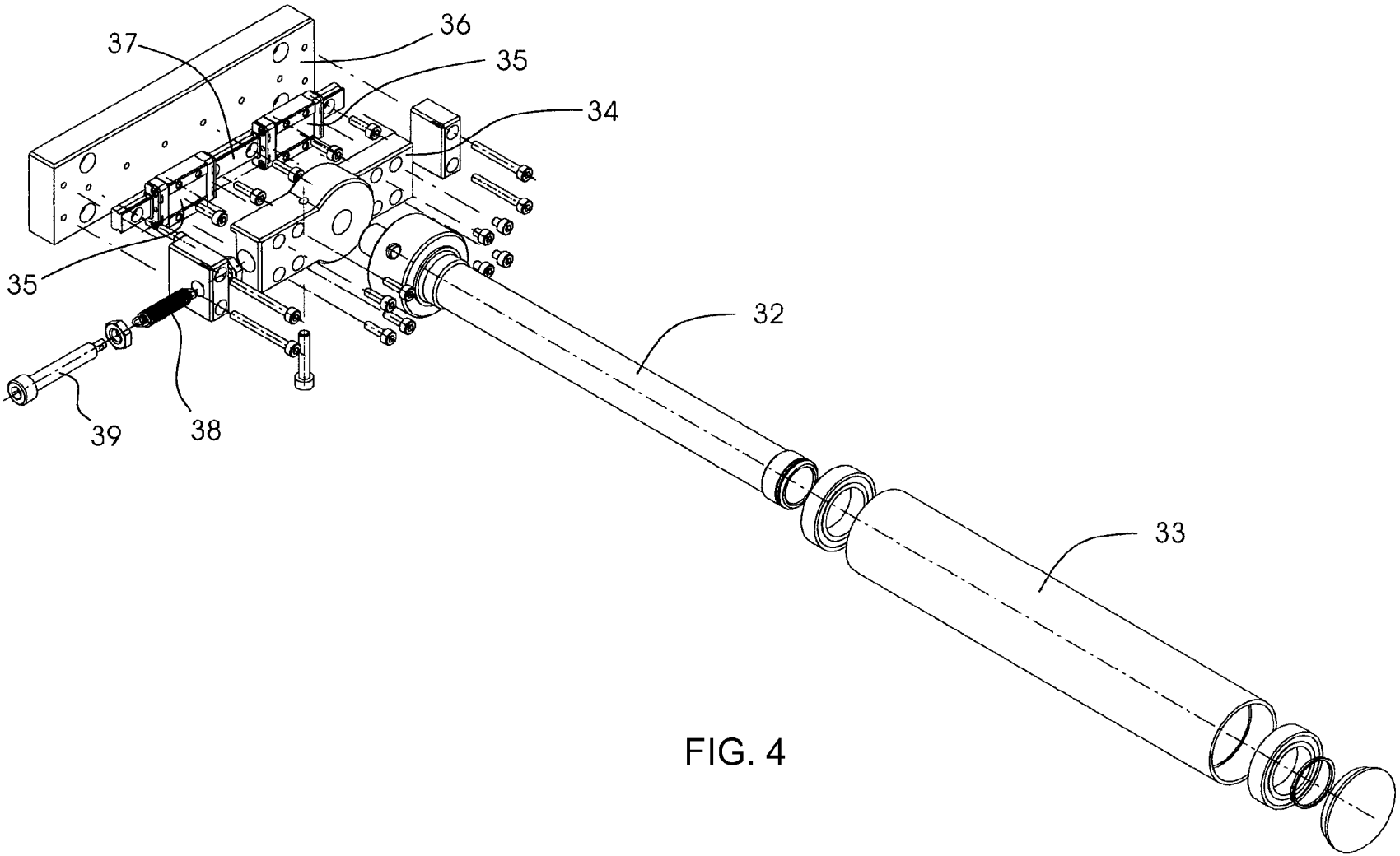
FIG. 4 is a diagrammatic, perspective exploded view of a structural part shown in FIG. 3.

In FIG. 4, an exploded representation of the structural part shown in FIG. 3 can be seen. The dancing roller 32 has a substantially hollow-cylindrical casing sleeve 33, the outer casing surface of which can also be of crowned construction. The slide 34 is received by two bearings 35 on a linear guide rail 37, which, in turn, is fastened to the base 36. The tension spring 38 is connected to the adjusting screw 39 and the slide 34.

Figure 5:
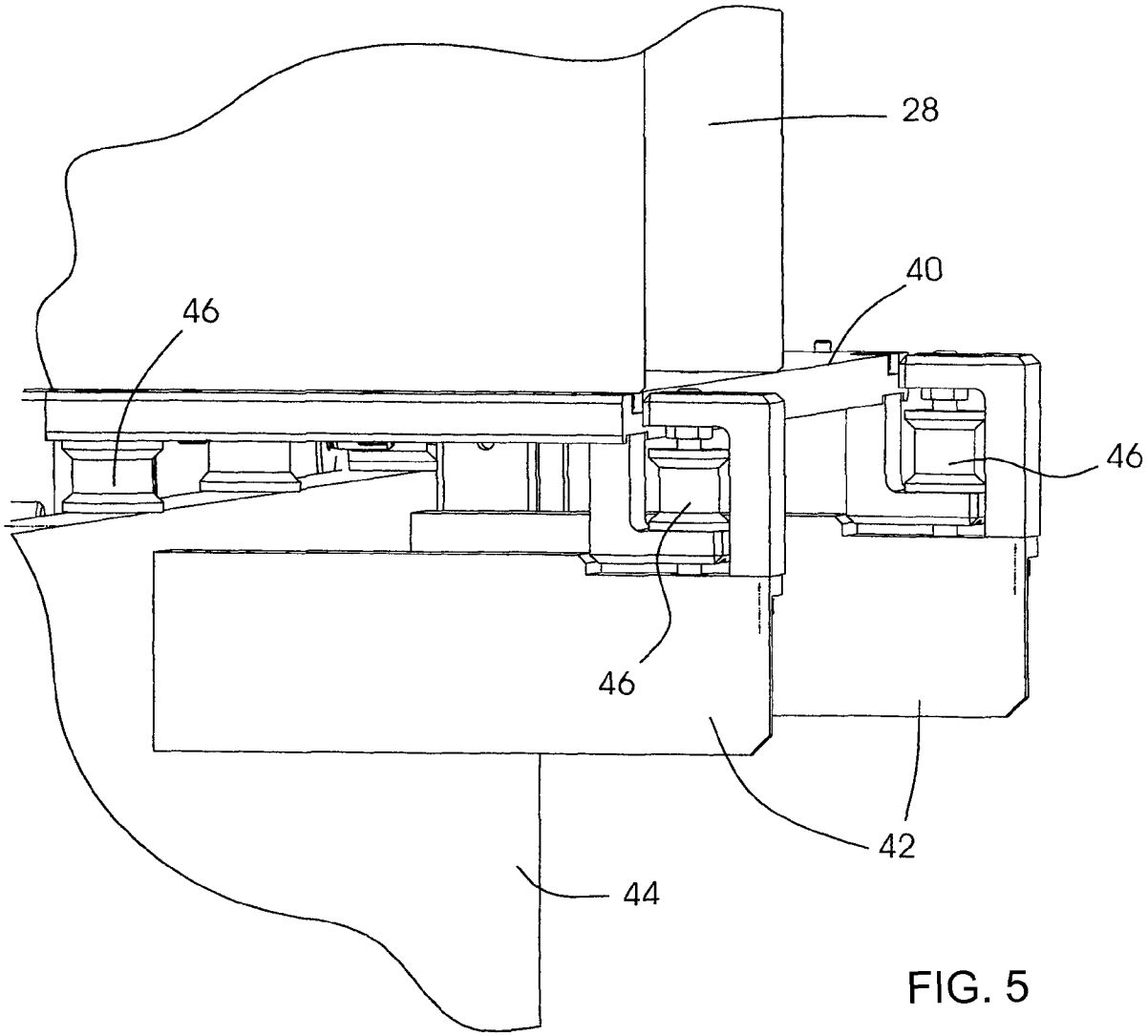
FIG. 5 is a diagrammatic, perspective detailed view of a mounting of a printing apparatus on vibration pickups.

FIG. 5 shows a detailed view of the mounting of the printing apparatus 28 and the UV drying device 30 on vibration pickups 46. With the vibration pickups 46 according to the invention, the printing apparatus 28 and the UV drying device 30 is decoupled from the vibrations of the packaging machine 10. In order to prevent shocks from the rest of the packaging machine 10 from acting upon the integrated printing apparatus 10 with the UV drying device 30, a constructive, mechanical vibration insulation is provided. A base plate 40 of the printing apparatus 28 and of the UV drying device 30 is accommodated indirectly on supports 42 and on a rear wall 44 via vibration pickups 46, in particular rubber-metal buffers.

Figure 6:
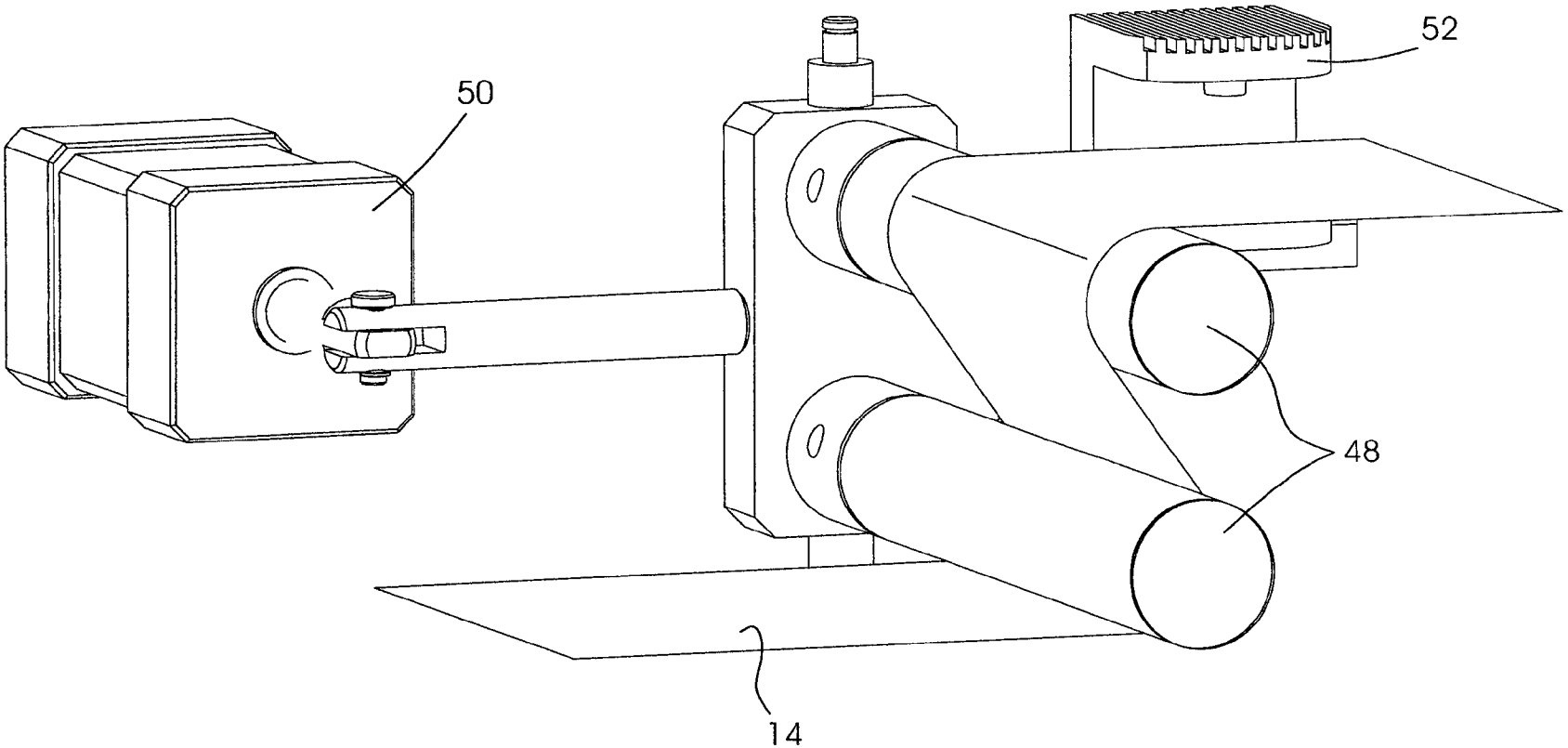
FIG. 6 is a diagrammatic, perspective view of an embodiment of an active lateral web control in one embodiment of the packaging machine according to the invention.

FIG. 6 relates schematically to the refinement of the packaging machine 10 according to the invention in an embodiment containing an active lateral web control. The lateral web control can be realized, for example, before the printing apparatus 28. The blister film web 14 passes through a pair of web guide rollers 48, the location of which can be varied with a drive element 50, so that a lateral displacement of the course of the blister film web 14 results. The location of the web is detected by an optical detector 52. An adjustment of the lateral location of the blister film web 14 as a function of the measurement of the detector 52 can also be realized.

Figure 7:
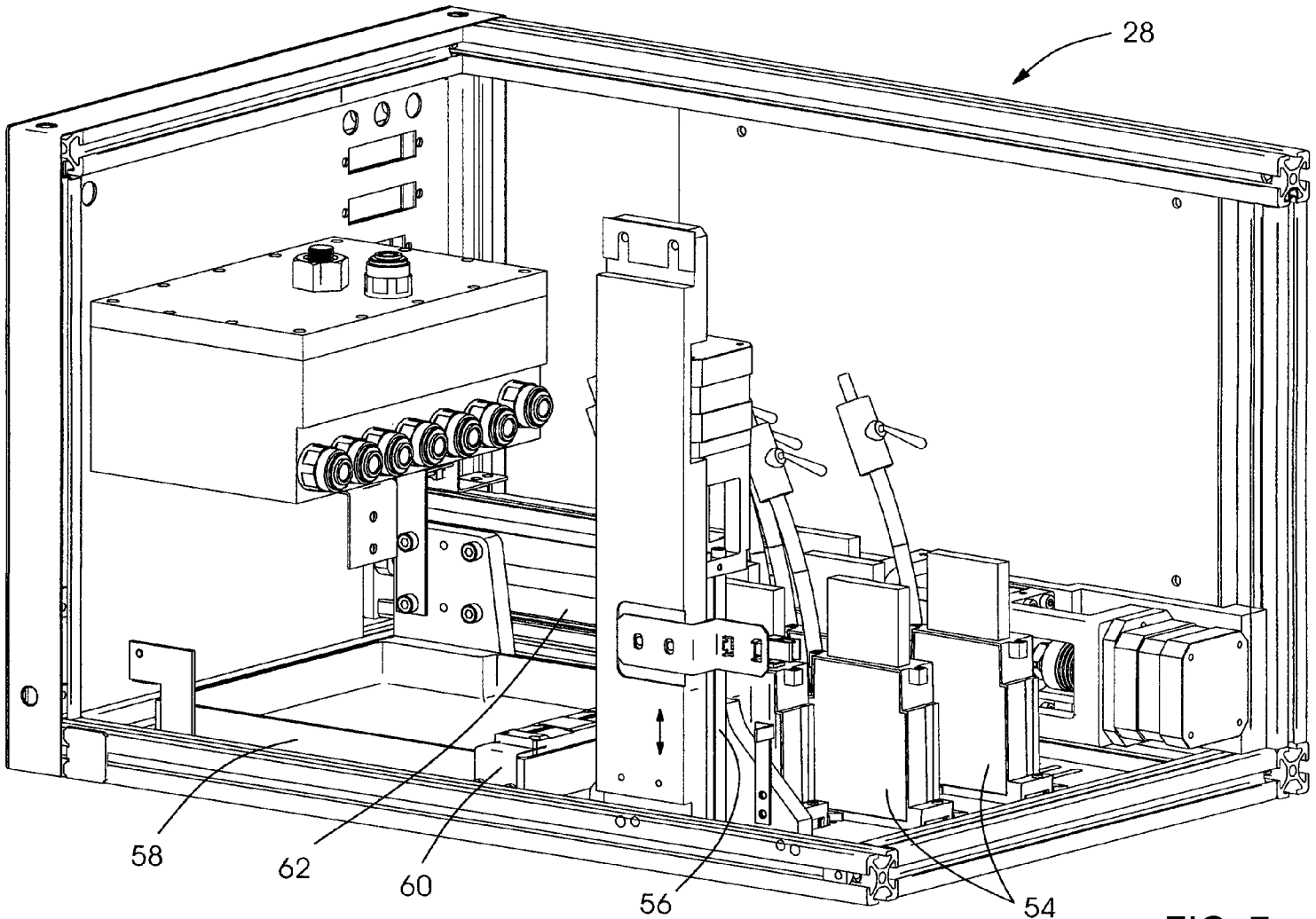
FIG. 7 is a diagrammatic, perspective view of an advantageous embodiment of the printing apparatus, in which printing modules are in the printing position.

FIG. 7 is a detailed view of an advantageous embodiment of the printing apparatus 28. In the shown view, the printing modules 54 can be seen in the printing position. The embodiment is particularly compact, it contains an arrangement of a plurality of printing modules 54 for inkjet printing (drop-on-demand inkjet modules), each having a plurality of individual inkjet nozzles, such that the blister film web can be printed on in page width, an electronics for distributing the print data, as well as a drive unit for the printing modules, an ink supply and an automatic printhead cleaning. A mounting plate of the printing modules 54 can be moved along a first linear guide 56 in the vertical direction (indicated by the double arrow). In a rest position beneath the ink tank of the ink supply next to the printing modules can be found, in space-saving arrangement, a purge pan 58, to which a cleaning apparatus 60 is attached substantially to the same structural height. Along a second linear guide 62, the purge pan 58 and the cleaning apparatus 60 can be moved in the horizontal direction.

Figure 8:
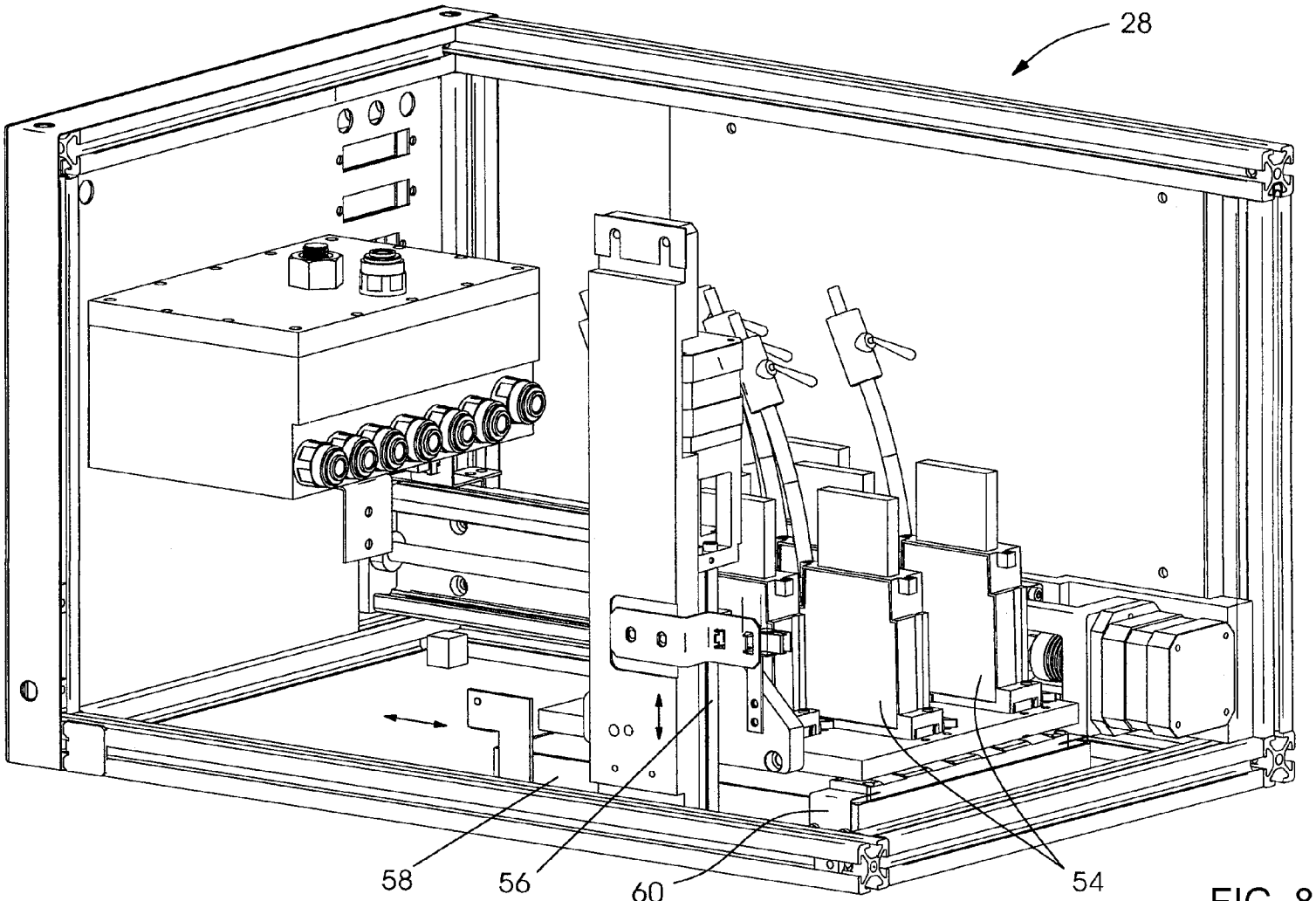
FIG. 8 is a diagrammatic, perspective view of the advantageous embodiment of the printing apparatus from FIG. 7, in which the printing modules are in a cleaning position.

In FIG. 8, a further detailed view of the advantageous embodiment of the printing apparatus 28 from FIG. 7 is shown. In the represented situation, the printing modules 54 are in the cleaning position. The purge pan 58 with the cleaning apparatus 60 has been moved below the printing modules 54. Upon a return movement of the purge pan 58 in the horizontal direction, the nozzle plate of the printing modules 54 is simultaneously cleaned. Surplus ink is removed, particularly without contact, with vacuum suction cups of the cleaning apparatus 60. The cleaning can be realized by cyclical to-and-fro movement of the purge pan 58 with the cleaning apparatus 60.

At the user interface (not diagrammatized) for the control of the printing apparatus 28, the following parameters, in particular, can be specified or selected: the number of cleaning cycles, the variation in cleaning speed and the variation in underpressure in the vacuum suction.

The invention claimed is:

1. A packaging machine for goods in blister shell moldings to be sealed with a blister film, the packaging machine comprising:

a first transport system for a blister film web;

a second transport system for the blister shell moldings;

one of said first and second transport systems including an unreeling device for the blister film web;

a sealing apparatus for connecting a blister shell molding to a portion of the blister film web to seal the blister shell molding;

a printing apparatus for applying optical information to the blister film web;

a dancing roller system for motional decoupling disposed between a position at which said printing apparatus prints on the blister film web and a position of said sealing apparatus along the blister film web;

a further dancing roller system for motional decoupling being disposed along the blister film web between a position of said unreeling device and said position at which said printing apparatus prints on the blister film web; and at least one of said printing apparatus and said first transport system for the blister film web contains an apparatus for insulating against occurring vibrations of a rest of the packaging machine at said position at which said printing apparatus prints on the blister film web.

2. The packaging machine according to claim 1, wherein said printing apparatus is an inkjet printing system.

3. The packaging machine according to claim 1, wherein said dancing roller system has:

a restoring element; and a deflection roller, displaceable counter to a force of said restoring element, for damping longitudinal running vibrations of the blister film web.

4. The packaging machine according to claim 1, further comprising a plurality of mechanical vibration pickups by means of which vibrations acting on said printing apparatus are damped.

5. The packaging machine according to claim 4, wherein said plurality of mechanical vibration pickups are one of rubber-metal buffers and steel-wire-damped springs.

6. The packaging machine according to claim 1, further comprising a single motor drive for moving the blister film web along said printing apparatus.

7. The packaging machine according to claim 1, further comprising:

a sealing roller;

a UV drying apparatus disposed downstream of said printing apparatus along the blister film web, said UV drying apparatus disposed upstream of said sealing roller.

8. The packaging machine according to claim 3, wherein said deflection roller for the blister film web is of crowned construction.

9. The packaging machine according to claim 1, further comprising:

a guide mechanism for stabilizing a movement of the blister film web in a direction transversely to a feed direction; and a control unit for driving said guide mechanism.

10. The packaging machine according to claim 2, wherein said inkjet printing system contains a carrier plate, a plurality of printing modules disposed in said carrier plate, and a purge pan with a cleaning apparatus accommodated on one side of said purge pan, said plurality of printing modules being movable in a vertical direction and being advanceable to the blister film web, and said purge pan with said cleaning apparatus being movable in a horizontal direction from a parking position into a cleaning position below said printing modules, and back.

11. The packaging machine according to claim 10, wherein said cleaning apparatus contains a contactless vacuum for extracting ink from said printing modules.

* * * * *